US011493192B2

(12) United States Patent
Kaye et al.

(10) Patent No.: US 11,493,192 B2
(45) Date of Patent: Nov. 8, 2022

(54) LIGHTING SYSTEM WITH DETACHABLE FLASHLIGHT HEAD

(71) Applicant: LB Marketing, Inc., Alpharetta, GA (US)

(72) Inventors: Douglas R. Kaye, Alpharetta, GA (US); Kevin Joseph Brown, Alpharetta, GA (US); Elvis Isai Perez-Castro, Alpharetta, GA (US); Kelly Dawn Hires, Alpharetta, GA (US); Lauren Lindley, Alpharetta, GA (US)

(73) Assignee: LB MARKETING, INC., Alpharetta, GA (US)

( * ) Notice: Subject to any disclaimer, the term of this patent is extended or adjusted under 35 U.S.C. 154(b) by 0 days.

(21) Appl. No.: 17/109,682

(22) Filed: Dec. 2, 2020

(65) Prior Publication Data

US 2021/0172588 A1 Jun. 10, 2021

Related U.S. Application Data

(60) Provisional application No. 62/943,936, filed on Dec. 5, 2019.

(51) Int. Cl.
*F21V 21/096* (2006.01)
*F21V 21/084* (2006.01)
(Continued)

(52) U.S. Cl.
CPC ..... *F21V 21/0965* (2013.01); *F21V 21/084* (2013.01); *F21V 23/003* (2013.01);
(Continued)

(58) Field of Classification Search
CPC .. F21V 21/0965; F21V 21/084; F21V 23/003; F21V 23/0471; F21V 23/06;
(Continued)

(56) References Cited

U.S. PATENT DOCUMENTS 3,601,595 A * 8/1971 Kivela ..... F21V 21/0885 362/190
5,239,451 A * 8/1993 Menke ..... H01M 50/213 362/199

(Continued)

FOREIGN PATENT DOCUMENTS

CN 101706043 A 5/2010

OTHER PUBLICATIONS

Chinese Office Action for Patent Application No. 202011438476.5 dated Jul. 18, 2022, pp. 1-16 (Translation Included).

*Primary Examiner* — Rajarshi Chakraborty
*Assistant Examiner* — Glenn D Zimmerman
(74) *Attorney, Agent, or Firm* — Thomas|Horstemeyer, LLP

(57) ABSTRACT

Disclosed are various embodiments for a lighting system. The lighting system may include a headguard adapted to be worn on a head of an operator, where the headguard comprising a headguard cavity, as well as an elongated flashlight base comprising a flashlight base cavity. A detachable flashlight head is adapted to be positioned in either of the headguard cavity and the flashlight base cavity. The detachable flashlight is sized and positioned such that, when positioned in the headguard cavity, the detachable flashlight magnetically and electrically couples to the headguard. Similarly, the detachable flashlight is sized and positioned such that, when positioned in the flashlight base cavity, the detachable flashlight magnetically and electrically couples to the elongated flashlight base.

14 Claims, 15 Drawing Sheets

(51) Int. Cl.

| | |
|---|---|
| ***F21V 23/04*** | (2006.01) |
| ***F21V 23/06*** | (2006.01) |
| ***F21V 23/00*** | (2015.01) |
| *F21Y 113/10* | (2016.01) |
| *F21Y 115/10* | (2016.01) |

(52) U.S. Cl.
CPC ..... *F21V 23/0471* (2013.01); *F21V 23/06* (2013.01); *F21Y 2113/10* (2016.08); *F21Y 2115/10* (2016.08)

(58) Field of Classification Search
CPC ..... F21V 21/06; F21V 21/08; F21Y 2113/10; F21Y 2115/10; F21L 4/04
See application file for complete search history.

(56) References Cited

U.S. PATENT DOCUMENTS

| | | | | |
|---|---|---|---|---|
| 10,047,938 | B2 | 8/2018 | Grider et al. | |
| 10,317,052 | B2 * | 6/2019 | King, Jr. ..... | F21V 21/116 |
| 2009/0207617 | A1 * | 8/2009 | Merchant ..... | F21V 29/74 362/294 |
| 2012/0182748 | A1 * | 7/2012 | McCaslin ..... | F21V 23/06 362/105 |
| 2018/0274768 | A1 * | 9/2018 | Grider ..... | F21V 23/005 |

* cited by examiner

FIG. 16
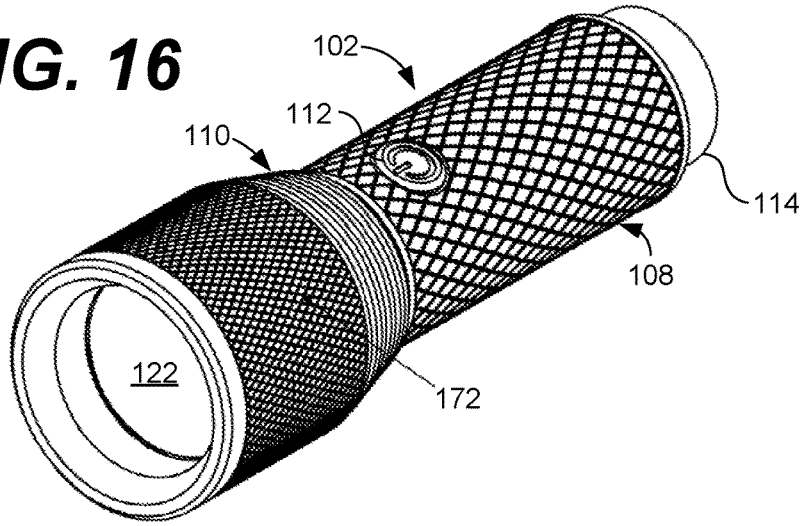
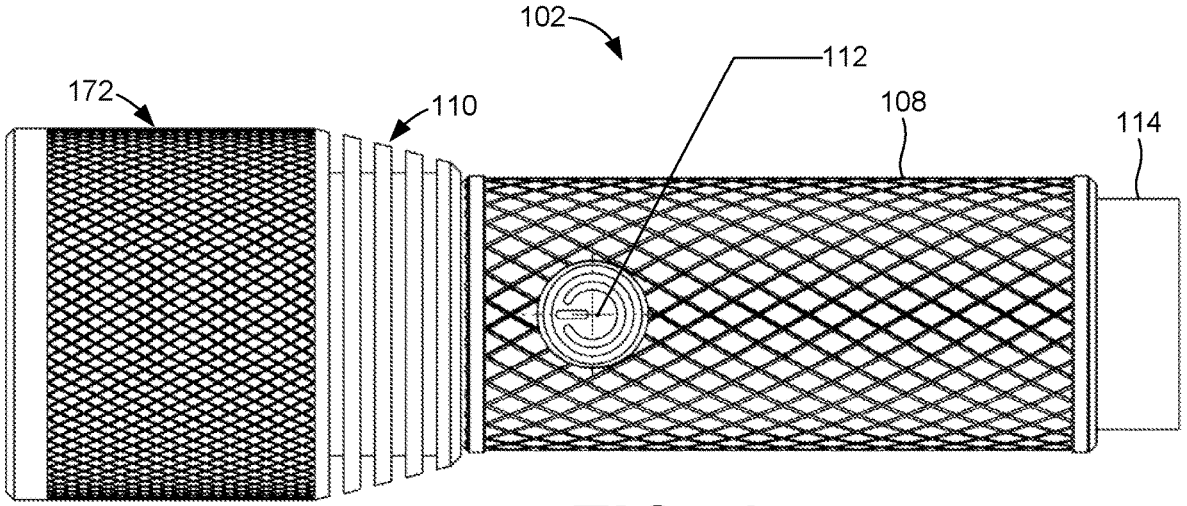
FIG. 17

LIGHTING SYSTEM WITH DETACHABLE FLASHLIGHT HEAD

CROSS-REFERENCE TO RELATED APPLICATION

This application claims the benefit of and priority to U.S. Provisional Application No. 62/943,936 entitled "LIGHTING SYSTEM WITH DETACHABLE FLASHLIGHT HEAD," filed Dec. 5, 2019, the contents of which being incorporated by reference in their entirety herein.

BACKGROUND

Several forms of hands-free lighting exist. For instance, lighting devices are often found mounted on helmets or headbands, which prove useful in law enforcement, mining, construction, automotive, manufacturing, or other industries that frequently require hands-free lighting solutions. Existing lighting devices, however, generally include a lighting element that is fixed and not removable from a helmet, headband, or other device. Some removable lighting devices exist; however, these lighting devices are not suitable for hands-free operation and are often not easily removable or attachable to a helmet, headband, or other device.

FIELD OF THE INVENTION

The present invention relates to a portable lighting device. More specifically, the present invention relates to a lighting device that may be removably attached to a headlamp, flashlight, or other suitable base.

BRIEF DESCRIPTION OF THE DRAWINGS

Many aspects of the present disclosure may be better understood with reference to the following drawings. The components in the drawings are not necessarily to scale, emphasis instead being placed upon clearly illustrating the principles of the disclosure. Moreover, in the drawings, like reference numerals designate corresponding parts throughout the several views.

FIG. 16 is a top perspective view of the detachable flashlight head in accordance with various embodiments of the present disclosure.

FIG. 17 is a top elevation view of the detachable flashlight head in accordance with various embodiments of the present disclosure.

DETAILED DESCRIPTION

The present disclosure relates to a lighting system having a detachable lighting device that may be removably attached to a headguard, flashlight body, or other suitable base, such that the lighting device may be toggled between a shortened flashlight, an elongated flashlight, and a head-mounted light (i.e., a headlamp). Existing hands-free illumination devices generally include a fixed lighting element that is not removable from a helmet or headband. While some devices include a removable lighting element, generally, these devices are not optimal for hands-free illumination. For instance, the removal and reattachment of lighting elements in existing products may be time and labor intensive. Additionally, these lighting elements are not rechargeable. Providing a detachable and rechargeable lighting element that may be easily removed, attached, and secured to a helmet, headband, or other head-mounted device can present significant technical challenges.

Accordingly, in various embodiments of the present disclosure, a lighting system is described that has a detachable flashlight head that may be moved among bases based on a desired mode of operation. The lighting system may include a headguard (e.g., base 1) adapted to be worn on a head of an operator, where the headguard comprises a headguard cavity. The lighting system may further include an elongated flashlight base (e.g., base 2) comprising a flashlight base cavity. A detachable flashlight head is adapted to be positioned in either the headguard cavity and/or the flashlight base cavity. The detachable flashlight is sized and positioned such that, when positioned in the headguard cavity, the detachable flashlight magnetically and electrically couples to the headguard. Similarly, the detachable flashlight is sized and positioned such that, when positioned in the flashlight base cavity, the detachable flashlight magnetically and electrically couples to the elongated flashlight base.

In the following discussion, a general description of a lighting system having a detachable flashlight head is provided, followed by a discussion of operation of the same.

Figure 1:
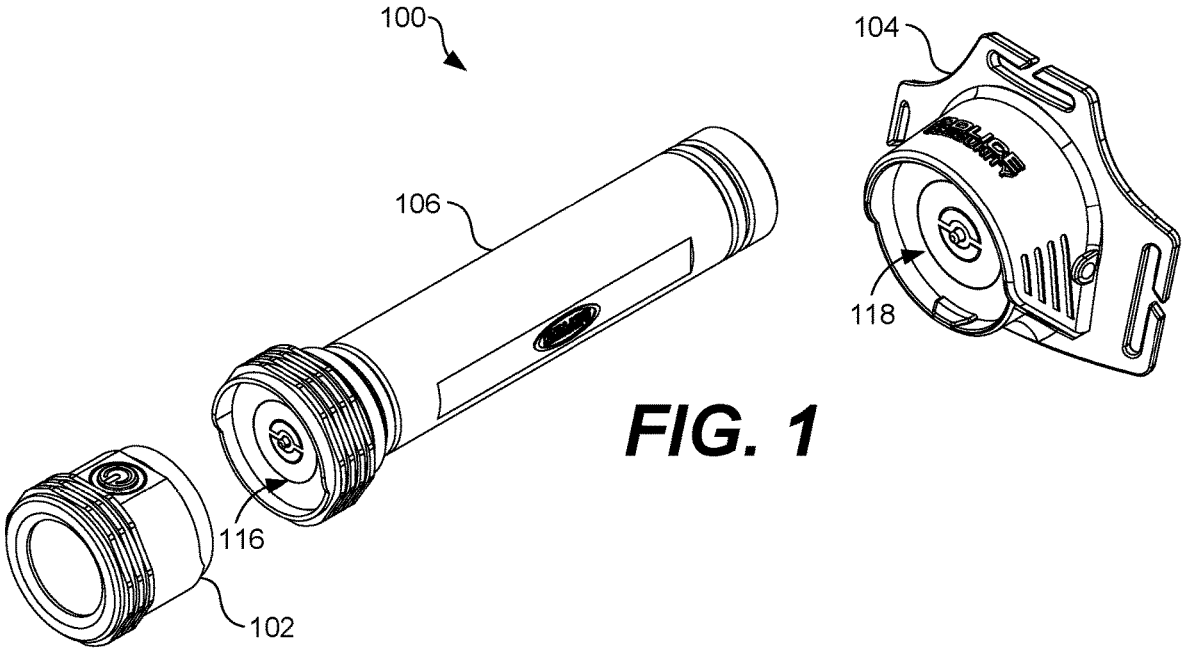
FIG. 1 is a top perspective view of a lighting system showing a detachable flashlight head, a headguard, and a flashlight base in accordance with various embodiments of the present disclosure.
Figure 2:
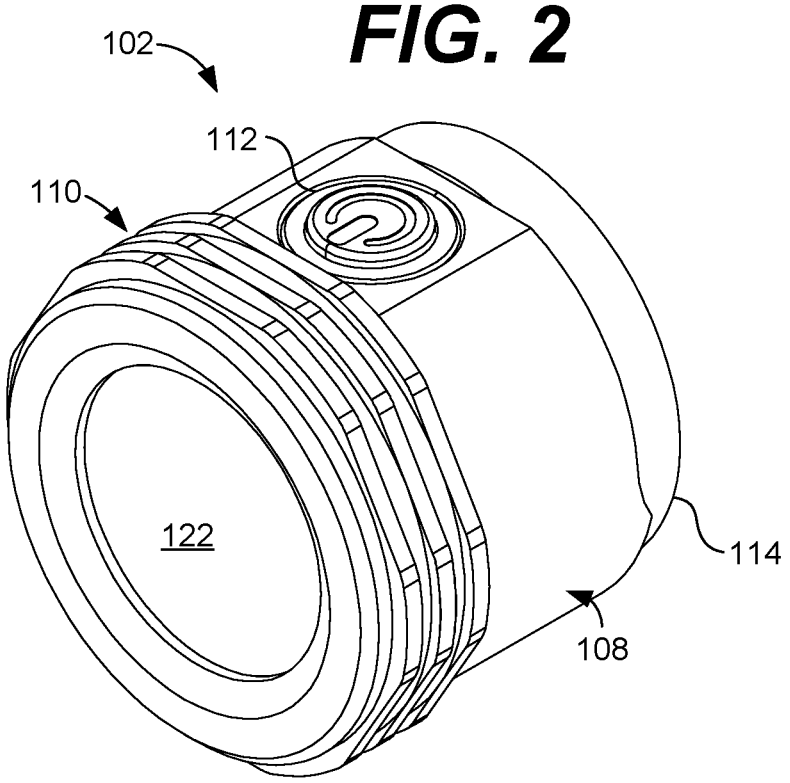
FIG. 2 is an enlarged view of the detachable flashlight head of FIG. 1 in accordance with various embodiments of the present disclosure.
Figure 3:
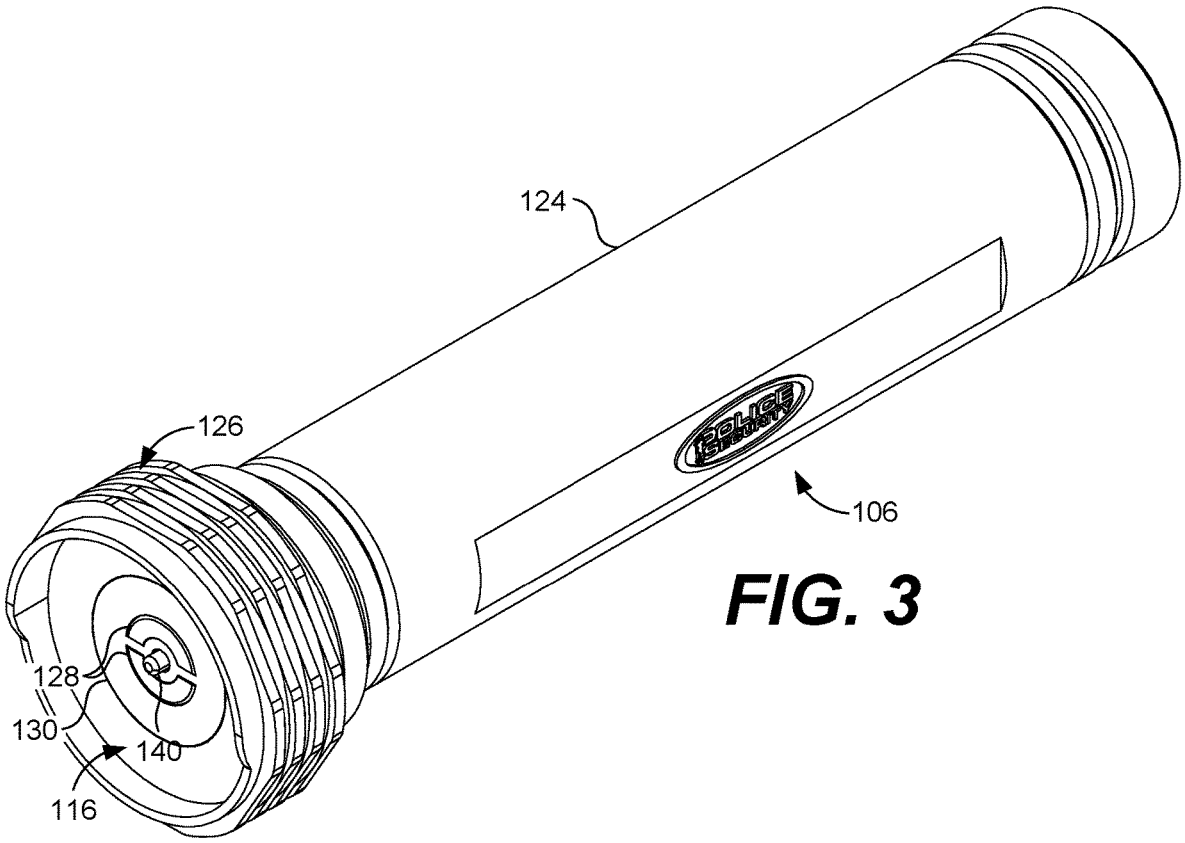
FIG. 3 is an enlarged view of the flashlight base of FIG. 1 in accordance with various embodiments of the present disclosure.
Figure 4:
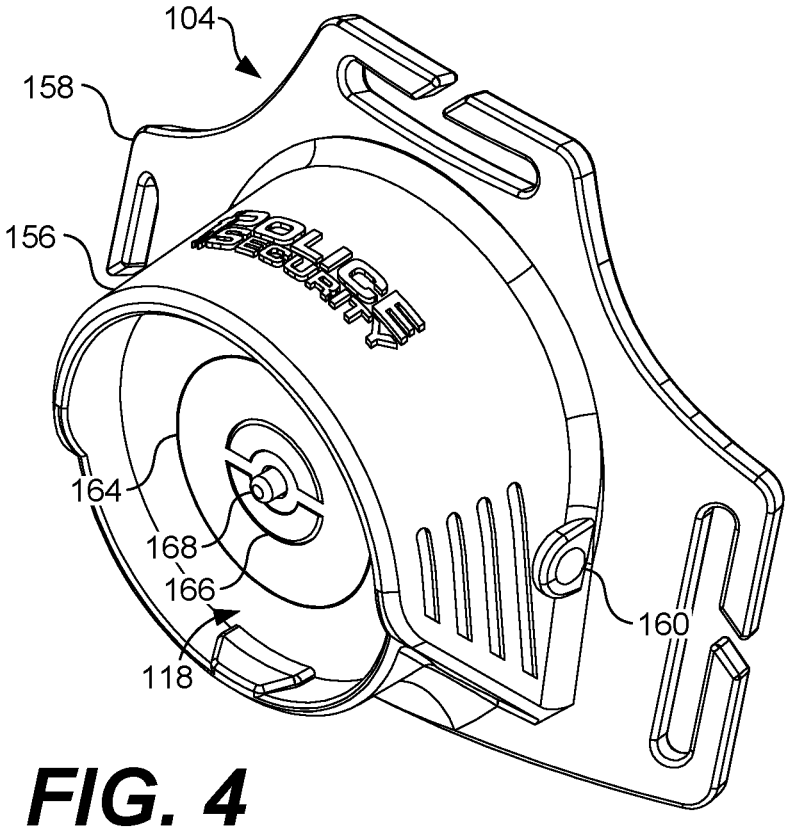
FIG. 4 is an enlarged view of the headguard of FIG. 1 in accordance with various embodiments of the present disclosure.

Referring now to FIG. 1, an embodiment of a lighting system 100 is shown that includes a detachable flashlight head 102, a headguard 104, and a flashlight base 106. Enlarged views of the detachable flashlight head 102, the flashlight base 106, and the headguard 104, are shown in FIGS. 2, 3, and 4, respectively. Referring to FIGS. 1-4 collectively, the headguard 104 may include a device adapted to be worn on a head of an operator. For instance, a body of the headguard 104 may be ergonomically countered to fit on or near a forehead of an individual, on a front of a helmet, etc. As such, when the detachable flashlight head 102 is affixed to the headguard 104, the headguard 104 may provide an operator with a hands-free source of lighting for various uses. However, in some situations, it is beneficial to have a hand-held source of light. For instance, a hand-held flashlight may provide a better source of light in hard-to-reach places, or in various cavities and workspaces. As such, the detachable flashlight head 102 may be detached from the headguard 104 such that the detachable flashlight head 102 may be operated as a hand-held source of light.

Accordingly, in some desired modes of operation, the detachable flashlight head 102 is configured to operate in conjunction with at least one of the headguard 104 and the flashlight base 106. For instance, the detachable flashlight head 102 may be coupled to the flashlight base 106 to provide the operator with a larger flashlight body, which is desirable for certain types of applications in which lighting is required, such as law enforcement. In another example, the detachable flashlight head 102 may be coupled to the headguard 104 to provide the operator with a headlamp or a hands-free lighting solution, which is more practical for certain types of applications in which hands-free lighting is required, such as mining, construction, vehicle maintenance, etc. In some embodiments, when the detachable flashlight head 102 is docked in the flashlight base 106 or the headguard 104, the lumens output by the detachable flashlight head 102 is configured to increase to produce a much higher illumination.

The detachable flashlight head 102 may operate independently of either the headguard 104 and/or the flashlight base 106. For instance, the detachable flashlight head 102 may include its own power supply such that, when the detachable flashlight head 102 is removed from the headguard 104 or the flashlight base 106, the detachable flashlight head 102 may operate as a small lighting device that may be positioned in locations in which a larger flashlight body or a headlamp is not practical. Notably, with reference to FIG. 1, the headguard 104 is shown while additional components of the headlamp, such as head straps and a power supply (e.g., an external battery pack), are not shown for explanatory purposes.

To facilitate the removability and independent operation of the detachable flashlight head 102, the detachable flashlight head 102 may include a power source independent of the headguard 104 and the flashlight base 106. For instance, in some embodiments, the detachable flashlight head 102 may include one or more batteries that permit the detachable flashlight head 102 to power one or more light sources, such as light emitting diodes (LEDs) or light bulbs, independent of a power supply or other light source of the headguard 104 and the flashlight base 106. The batteries may include rechargeable batteries in some embodiments.

Referring specifically to FIG. 2, an enlarged view of an embodiment of the detachable flashlight head 102 is shown. The detachable flashlight head 102 may include a flashlight head housing 108. In some embodiments, the flashlight head housing 108 may include a longitudinally extending and substantially tubular housing, as shown in FIG. 2. Further, the flashlight head housing 108 may include one or more ridges 110 projecting from a surface of the flashlight head housing 108 in various regions of the flashlight head housing 108 that facilitate gripping the detachable flashlight head 102 using the fingertips or other suitable portion of a hand. The ridges 110 are shown in a front portion of the flashlight base housing 124 in the embodiment of FIG. 2 to provide a bezel; however, the ridges 110 may be positioned towards a central region or a distal rear end of the flashlight head housing 108 in some embodiments. The detachable flashlight head 102 may include a head switch 112 that may be positioned on a top portion of the detachable flashlight head 102. The head switch 112 may be coupled to circuitry of the detachable flashlight head 102 for toggling the lighting element (e.g., a LED) between on-and-off positions or between different modes of operation (e.g., strobing, high intensity illumination, low intensity illumination, etc.).

The flashlight head housing 108 may further include a base 114 having a width and/or diameter less than the central and/or front portion of the flashlight head housing 108. As such, the base 114 may be positioned, nested, or otherwise placed in a cavity or an aperture of the flashlight base 106, headguard 104, or other suitable mount. For instance, referring back to FIG. 1, the base 114 of the detachable flashlight head 102 may be nested in a flashlight base cavity 116 of the flashlight base 106 or a headguard cavity 118 of the headguard 104 such that the base 114 is wholly or partially encapsulated by a projecting portion of the flashlight base 106 or the headguard 104. The detachable flashlight head 102 may further include a head light emitting diode (LED) 120 or other bulb, a lens 122, a reflector (not shown), and other components as may be appreciated.

Referring now to FIG. 3, an enlarged view of the flashlight base 106 is shown in accordance with various embodiments. The flashlight base 106 may include a flashlight base housing 124. In some embodiments, the flashlight base housing 124 may include a longitudinally extending and substantially tubular housing, as shown in FIG. 3, where the length of the flashlight base housing 124 is substantially longer than a length of the detachable flashlight head 102 (e.g., two to three times the length or larger). Like the detachable flashlight head 102, the flashlight base housing 124 may include one or more base ridges 126 projecting from the flashlight base housing 124 in various regions of the flashlight base housing 124 to facilitate gripping of the flashlight base 106 using a hand of the operator. The base ridges 126 are shown in a front portion of the flashlight base housing 124 in the embodiment of FIG. 3, thereby providing a bezel. However, alternatively or in combination with the foregoing, the base ridges 126 may be positioned towards a central region or a distal rear end of the flashlight base housing 124 in some embodiments.

When the detachable flashlight head 102 is positioned in the flashlight base cavity 116, the detachable flashlight head 102 may form a physical, magnetic, and/or electrical connection with the flashlight base 106. The physical connection may include an interference fit, a friction fit, a snap connection, or similar connection, as will be described in greater detail below.

In some embodiments, the magnetic attraction between the detachable flashlight head 102 and the flashlight base 106 is strong enough to align a rear face of the detachable flashlight head 102 such that an electrical connection is formed between the detachable flashlight head 102 and the flashlight base 106. As such, in addition to the flashlight base cavity 116, the flashlight base 106 may include base electrical contacts 128, base magnets 130, base LED(s) 132, base circuitry 134 (e.g., a printed circuit board (PCB)), batteries 136 (e.g., rechargeable batteries), a base switch 138, presence sensor 140, as well as other components. The electrical connection may charge a battery of the detachable flashlight head 102 and/or power the circuitry and the base LED(s) 132 of the detachable flashlight head 102.

As noted above, the flashlight base 106 may include one or more base LEDs 132 or other lighting elements to provide lighting in the flashlight base cavity 116 when the detachable flashlight head 102 is removed. As such, the flashlight base 106 may be described as having secondary illumination. The presence, or lack thereof, of the detachable flashlight head 102 may be determined using the presence sensor 140, which may include a mechanical sensor, an optical sensor, resistance detection sensor, capacitance detection sensor, or other suitable sensor to detect the presence, or lack thereof, of the detachable flashlight head 102. In further embodiments, the presence sensor 140 includes a push button, electrical connection sensor, or similar sensor.

In some embodiments, the flashlight base 106 may include a base switch 138, such as a power button. When the detachable flashlight head 102 is coupled to the flashlight base 106, the base switch 138 may toggle a lighting element, such as the head LED 120 in the detachable flashlight head 102 between on-and-off positions or between different modes of operation (e.g., strobing, high intensity illumination, low intensity illumination, etc.). When the detachable flashlight head 102 is detached from the flashlight base 106, the base switch 138 may toggle a lighting element, such as the base LED 132 in the flashlight base 106 between on-and-off positions or between different modes of operation (e.g., strobing, high intensity illumination, low intensity illumination, etc.).

In some embodiments, the base switch 138 may be formed of a transparent material having a multi-color LED or other lighting element disposed underneath. When the detachable flashlight head 102 is coupled to the flashlight base 106 and a charging process is initiated, the multi-color LED may cause the base switch 138 to illuminate a first color (e.g., red) during the charging process and change to a second, different color (e.g., green) when charging has completed. Additionally, the head switch 112 and a battery pack switch 142 on a battery pack 162, as will be described, may include similar functionality.

The detachable flashlight head 102 similarly has head electrical contacts 144 and head magnets 146 that are configured to contact and couple to the base electrical contacts 128 and base magnets 130 of the flashlight base 106, thereby forming magnetic and/or electrical connections, respectively. Additionally, the detachable flashlight head 102 includes lighting circuitry 148, a light cup 150, the head switch 112 (e.g., an on/off button), circuitry 152 (e.g., PCB boards), and one or more batteries 154 (e.g., rechargeable batteries). In some embodiments, the lighting circuit 148 has one or more lighting elements (e.g., head LEDs 120) disposed thereon, such as chip-on-board (COB) LEDs.

Turning now to FIG. 4, an enlarged view of the headguard 104 is shown according to various embodiments. The headguard 104 may include a flashlight receiver 156 defining the headguard cavity 118, pivoting knobs (not shown), headguard body (hereinafter "body 158") and a wire portal 160 through which a wire may be run to a battery pack 162, shown in FIG. 13, as well as other components as will be described. As noted above, the headguard 104 is adapted to be worn on a head of an operator. For instance, a body 158 of the headguard 104 may be ergonomically countered to fit on or near a forehead of an individual, or on a front of a helmet. As such, when the detachable flashlight head 102 is coupled to the headguard 104, the lighting system 100 may provide an operator with a hands-free source of lighting for various uses.

However, in some situations, it is beneficial to have a hand-held source of light. For instance, a hand-held flashlight may provide a better source of light in hard-to-reach places, or in various cavities and workspaces. As such, the detachable flashlight head 102 may be detached from the headguard 104, such that the detachable flashlight head 102 may be operated as a hand-held source of light or coupled to the flashlight base 106 to operate similar to a traditional flashlight.

Referring back to FIG. 1, and as noted above, the detachable flashlight head 102 may include a head switch 112 and the flashlight base 106 may include a base switch 138. The head switch 112 may be coupled to processing circuitry of the detachable flashlight head 102, and the base switch 138 may be coupled to processing circuitry of the flashlight base 106, as may be appreciated. The processing circuitry may include a PCB board, an integrated circuit (IC), and/or a microcontroller in some examples. Through operation of the processing circuitry, the switches 112, 138 may toggle a respective light source and/or a mode of operation of the detachable flashlight head 102.

For instance, in some embodiments, the switches 112, 138 may be manipulated by the operator to turn a light source of the detachable flashlight head 102 or a light source of the flashlight base 106 on or off. In addition to, or in lieu of the toggling of the light source, the switches 112, 138 may iterate through different modes of operation. The different modes of operation may include, for example, pulsating the light source (e.g., performing a strobe effect), providing a constant light source typical to a flashlight, varying the color of the light source, varying the luminous intensity of the light source, or other operations as may be appreciated.

Figure 12:
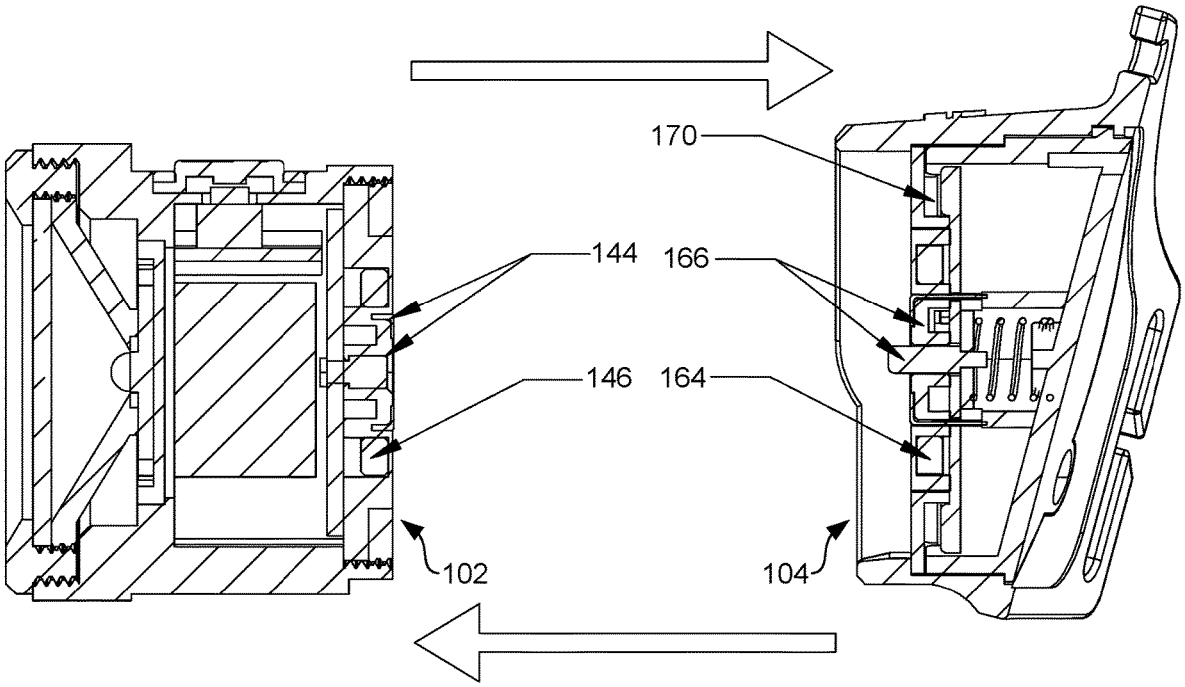
FIG. 12 is a cross-section view showing a coupling of the detachable flashlight head and the headguard in accordance with various embodiments of the present disclosure.

FIGS. 1, 4, and 12 further illustrate that the flashlight receiver 156 may include a headguard cavity 118 in which the detachable flashlight head 102 may be retained. More specifically, the base 114 of the detachable flashlight head 102 may be positioned in the headguard cavity 118, such that the base 114 is situated and retained therein through a slight interference fit, in addition to or in place of a magnetic coupling, as will be discussed. Similarly, the base 114 of the detachable flashlight head 102 may be positioned in the flashlight base cavity 116, such that the base 114 is situated and retained therein through a slight interference fit in addition to or in place of a magnetic coupling, as will be discussed.

To form a slight interference fit, the flashlight receiver 156 and/or the flashlight base cavity 116 may include a shape that substantially conforms to a shape of the base 114 of the detachable flashlight head 102. For instance, assuming the base 114 of the detachable flashlight head 102 includes a generally circular body with flat top and bottom portions, as shown in FIG. 1, the flashlight receiver 156 and/or the flashlight base cavity 116 may also include a generally circular body with flat top and bottom portions, as best illustrated in FIG. 4. The headguard 104 may be sized and positioned similarly. Additionally, the flashlight receiver 156 and/or the flashlight base cavity 116 may have a diameter substantially similar to, while slightly larger than, a diameter of the base 114 of the detachable flashlight head 102.

Referring collectively to FIGS. 1 and 4, in various embodiments, the base 114 may be retained in the headguard cavity 118 such that any torque or force applied on a distal top portion or a distal bottom portion of the detachable flashlight head 102 may cause the flashlight receiver 156 to pivot about an axis. Notably, pivoting occurs without causing the detachable flashlight head 102 to disengage from the headguard 104. Additionally, in embodiments in which the headguard 104 includes pivoting knobs, the pivoting knobs may be turned by the operator in a clockwise or counterclockwise direction, or otherwise manipulated, to pivot the flashlight receiver 156 and the detachable flashlight head 102 positioned therein about an axis.

The headguard 104 may further include a headguard magnet 164, headguard electrical contacts 166, presence sensor 168, headguard LED(s) 170, as well as other components. The headguard magnet 164 may be sized and positioned in the headguard cavity 118 such that, when the detachable flashlight head 102 is positioned in the headguard cavity 118, a magnetic coupling between a magnet of the detachable flashlight head 102 and the headguard magnet 164 is formed. As may be appreciated, the magnetic coupling further retains the detachable flashlight head 102 in the headguard cavity 118 until a predetermined amount of force is applied to remove the detachable flashlight from the headguard cavity 118. In some embodiments, the headguard magnet 164 includes an annular or circularly-shaped magnet positioned along the interior perimeter of the headguard cavity 118. However, other shapes and sizes of headguard magnets 164 may be employed as may be appreciated.

In some embodiments, circuitry is electrically coupled to one or more housing light sources (e.g., headguard LED(s) 170) which, like the flashlight base 106, may provide secondary illumination sources independent of the detachable flashlight head 102. In some embodiments, housing light sources may be disposed on the substrate of the circuit board. The housing light sources may include, for instance, one or more headguard LEDs 170 positioned, for instance, annularly around a perimeter of the circuit board or in another suitable arrangement. The lenses may be clear, transparent, or partially transparent, and may be positioned in the headguard cavity 118 such that light emitted by the housing light sources are visible, for instance, when the detachable flashlight head 102 is removed from the headguard cavity 118. As such, the headguard 104 may provide light independent of the detachable flashlight head 102 in some embodiments.

The headguard electrical contacts 166 may be positioned such that the headguard electrical contacts 166 engage with corresponding head electrical contacts 144 positioned on a rear end or other suitable location of the detachable flashlight head 102, thereby forming an electrical connection. Through the electrical connection, the detachable flashlight head 102 may be powered directly by a power supply (e.g., a battery pack) of the headguard 104, and/or a battery of the detachable flashlight head 102 which may be charged and re-charged.

The presence sensor 140 of the flashlight base 106 and the presence sensor 168 of the headguard 104 may include a mechanical, optical, resistive, capacitive, or other suitable sensor for detecting a presence of the detachable flashlight head 102 in the flashlight base cavity 116 of the flashlight base 106, the headguard cavity 118 of the headguard 104, or a lack thereof. In some embodiments, the presence sensor 140, 168 includes a pogo pin, which includes a spring-load and electrically conductive pin. In other embodiments, the presence sensor 140, 168 may include a stationary pin mounted to a PCB or other substrate, where the stationary pin includes a spring backing. The presence sensor 140 of the flashlight base 106 and/or the presence sensor 168 of the headguard 104 may trigger a light source on the flashlight base 106 or the headguard 104 to turn on when the detachable flashlight head 102 is removed from the flashlight base cavity 116 or the headguard cavity 118 of the headguard 104, or turn off when the detachable flashlight head 102 is returned or otherwise positioned in the flashlight base cavity 116 or the headguard cavity 118.

Figure 5:
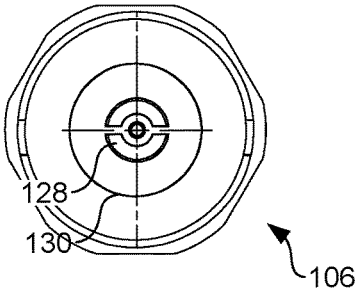
FIGS. 5-7 are various alternative views of the flashlight base of FIG. 1 in accordance with various embodiments of the present disclosure.
Figure 6:
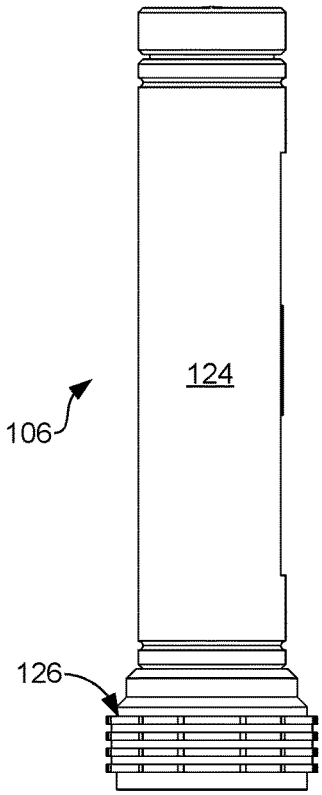
Figure 7:
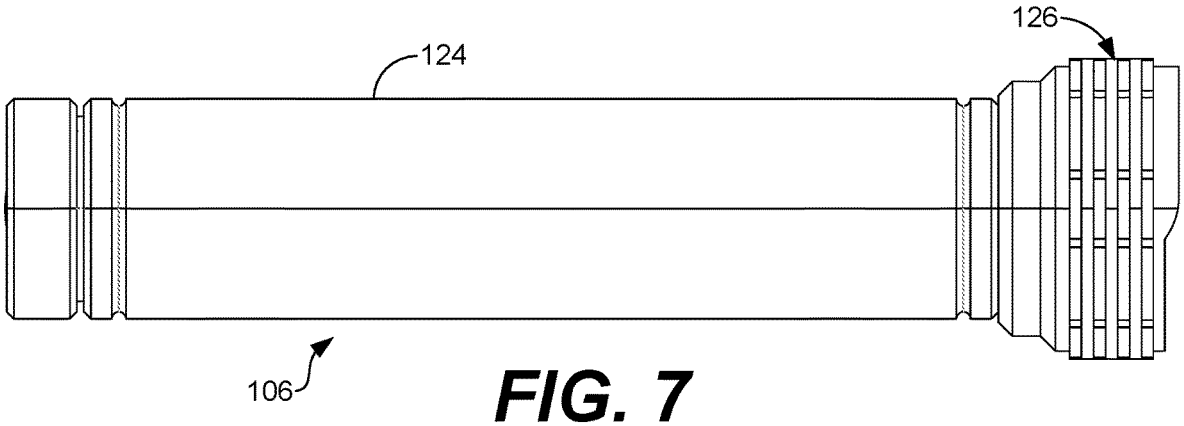
Figure 9:
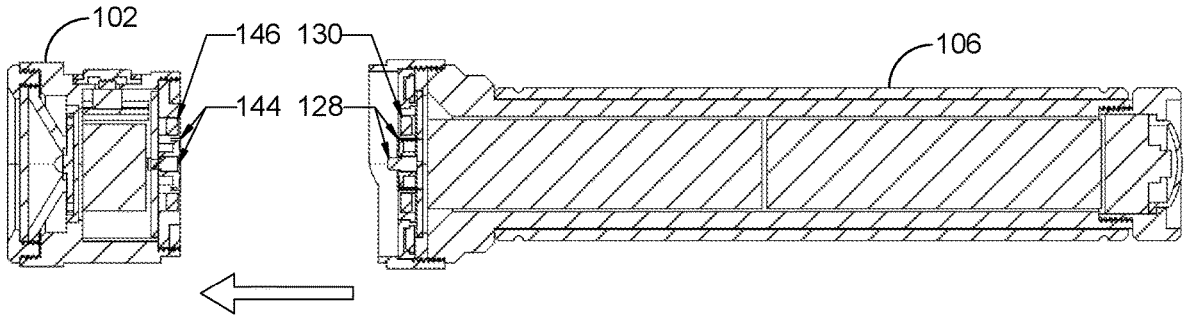
FIG. 9 is a cross-section view showing a coupling of the detachable flashlight head and the flashlight base in accordance with various embodiments of the present disclosure.
Figure 10:
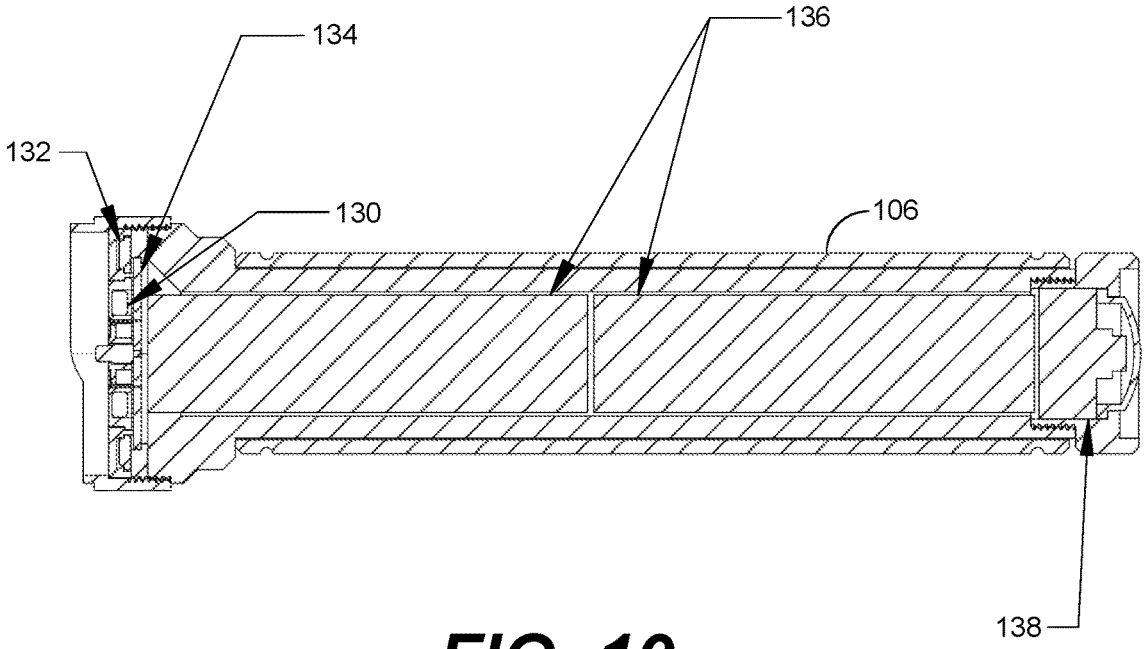
FIG. 10 is a cross-section view of the flashlight base of FIG. 1 in accordance with various embodiments of the present disclosure.

FIGS. 5-7 illustrate additional views of the flashlight base 106. Specifically, FIG. 5 is a front view of the flashlight base 106, FIG. 6 is a top view of the flashlight base 106, and FIG. 7 is a side view of the flashlight base 106. FIGS. 9 and 10 illustrate cross-sectional views of the flashlight base 106.

Figure 8A:
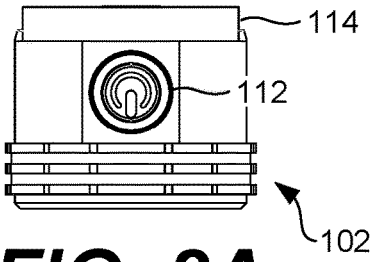
FIGS. 8A-8F are various views of the detachable flashlight head of FIG. 1 in accordance with various embodiments of the present disclosure.
Figure 8B:
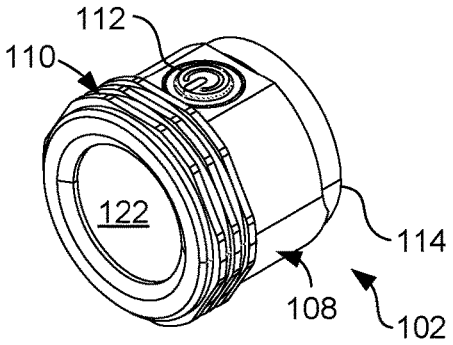
Figure 8C:
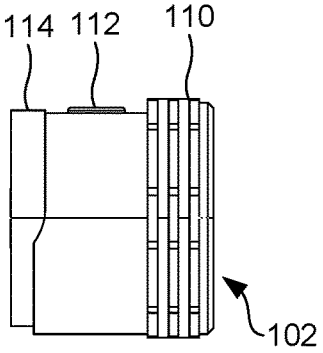
Figure 8D:
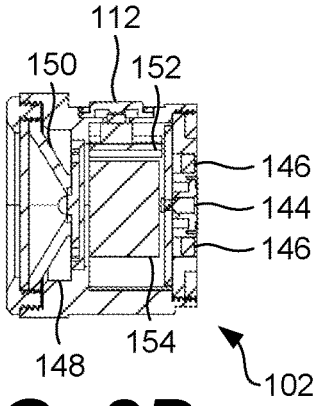
Figure 8E:
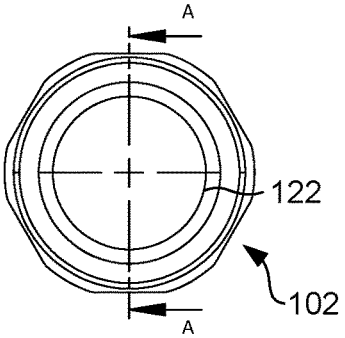
Figure 8F:
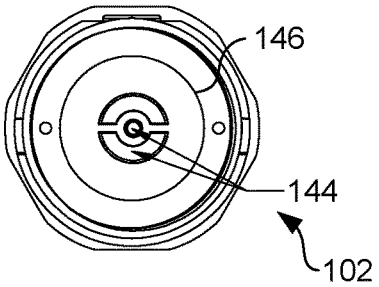

FIGS. 8A-8F illustrate various views of the detachable flashlight head 102. Specifically, FIG. 8A is a top view of the detachable flashlight head 102, FIG. 8B is a top perspective view of the detachable flashlight head 102, FIG. 8C is a side view of the detachable flashlight head 102, FIG. 8D is a side cross-sectional view of the detachable flashlight head 102, FIG. 8E is a front view of the detachable flashlight head 102, and FIG. 8F is a rear view of the detachable flashlight head 102.

Figure 11:
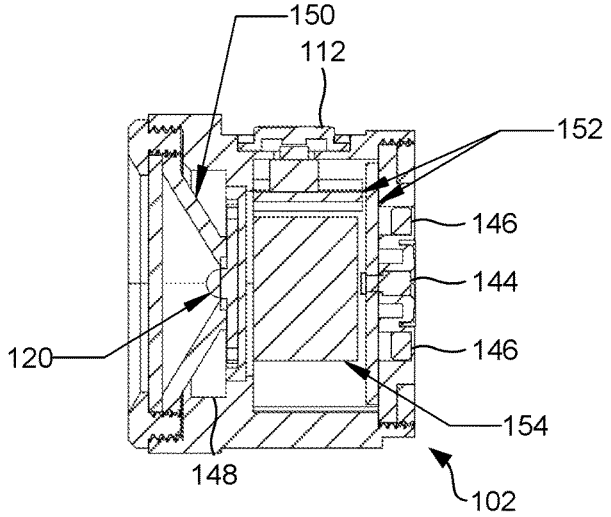
FIG. 11 is a cross-section view of the detachable flashlight head of FIG. 1 in accordance with various embodiments of the present disclosure.

FIG. 11 is an additional side cross-sectional view of the detachable flashlight head 102. FIG. 12 is a side cross-sectional view of the detachable flashlight head 102 shown relative to the headguard 104.

Figure 13A:
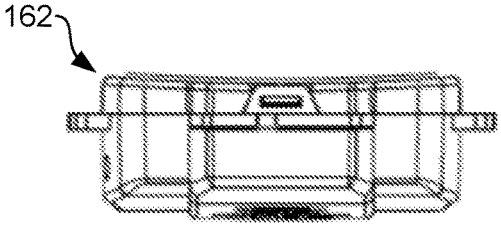
FIGS. 13A to 13G includes various views of a battery pack capable of being used with the headguard in accordance with various embodiments of the present disclosure.
Figure 13B:
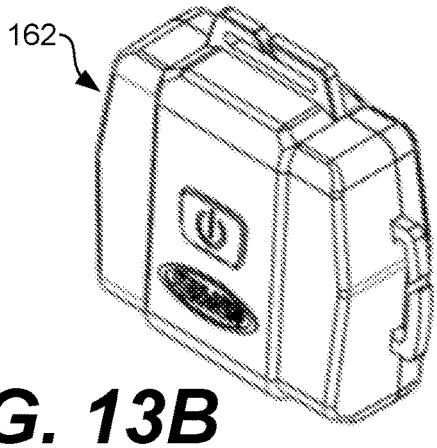
Figure 13C:
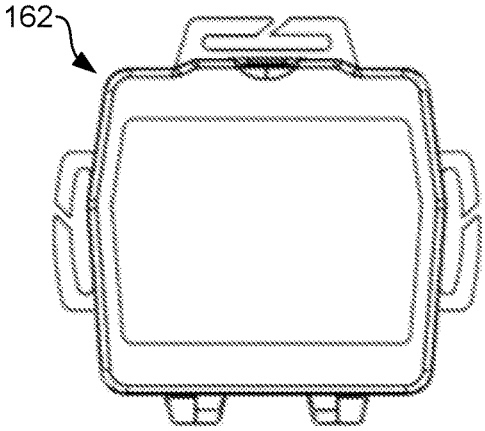
Figure 13D:
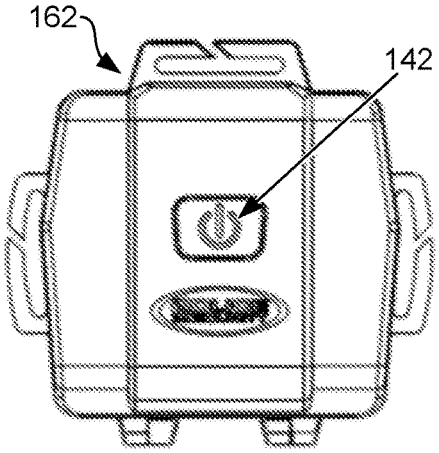
Figure 13E:
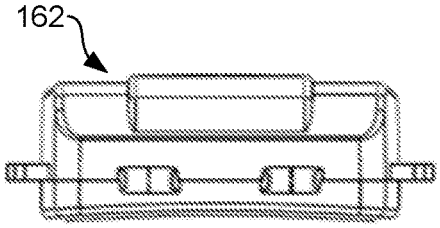
Figure 13F:
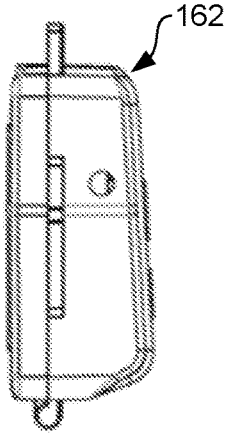
Figure 13G:
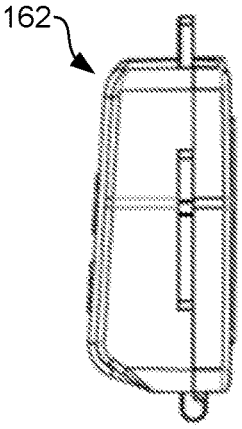

FIGS. 13A-13G include various views of a battery pack 162 that may be used in conjunction with the headguard 104, as may be appreciated. FIG. 13 is a top view of the battery pack 162, FIG. 13B is a top perspective view thereof, FIG. 13C is a front view thereof, FIG. 13D is a rear view thereof, FIG. 13E is a bottom view thereof, FIG. 13F is a first side view (e.g., a left side view) thereof, and FIG. 13G is a second side view (e.g., right side view) thereof.

In some embodiments, the battery pack 162 may include a battery pack switch 142 that, when pressed or otherwise manipulated, toggles through the modes of the detachable flashlight head 102, for instance, when the detachable flashlight head 102 is docked to the headguard 104. When the detachable flashlight head 102 is not docked in either the flashlight base 106 and/or the headguard 104, corresponding buttons on the components may control the secondary illumination (e.g., turning their LEDs off and on).

Figure 14:
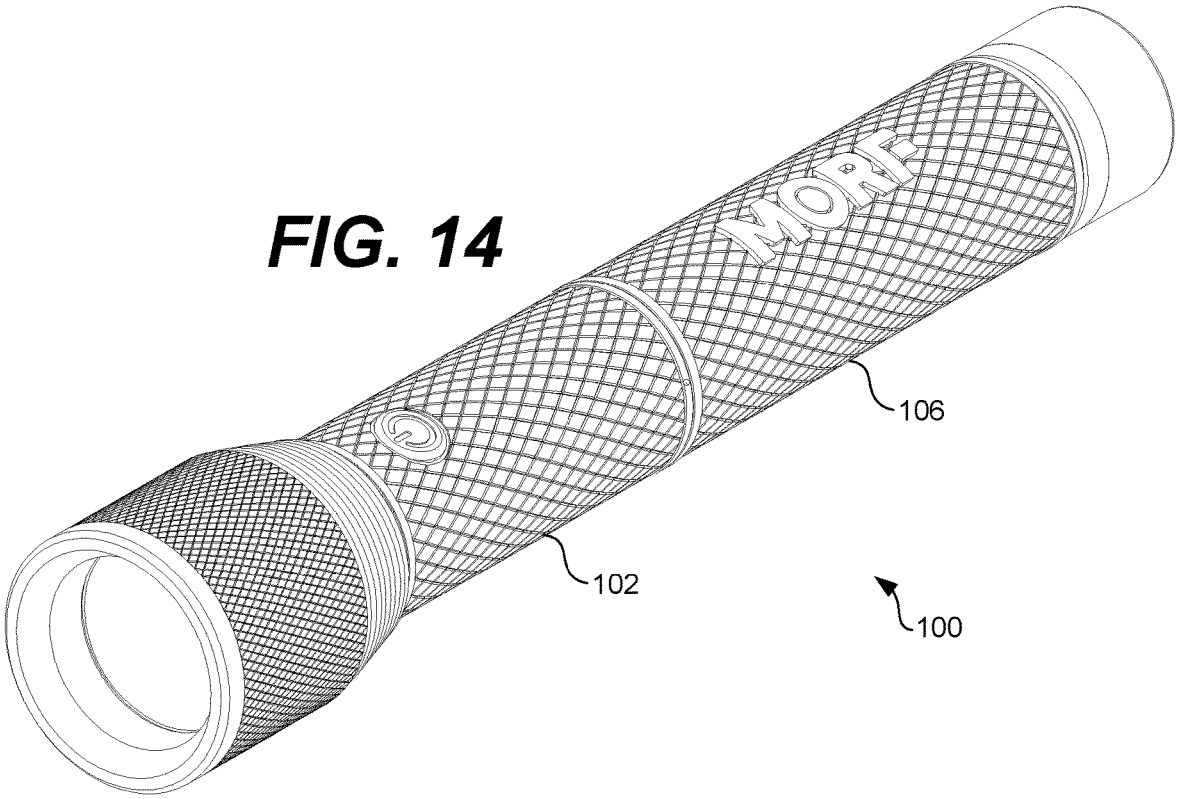
FIG. 14 is a top perspective view of another embodiment of the lighting system showing the detachable flashlight head and the flashlight base in accordance with various embodiments of the present disclosure.
Figure 15:
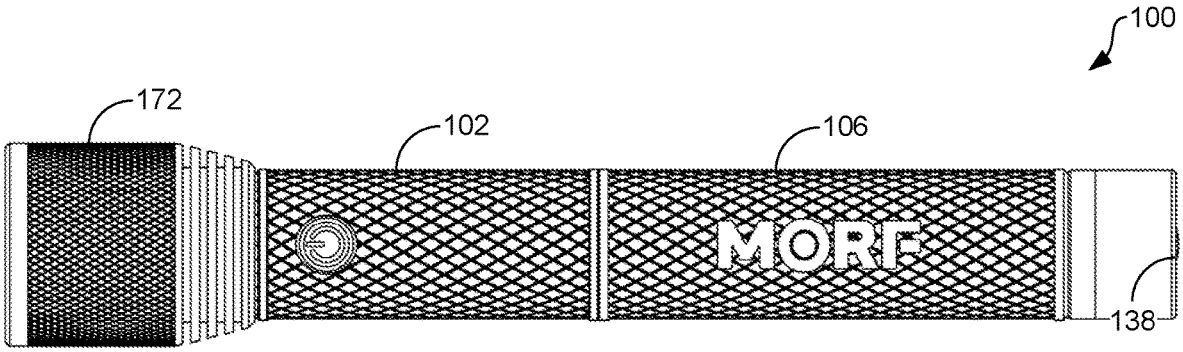
FIG. 15 is a top elevation view of the detachable flashlight head and the flashlight base in accordance with various embodiments of the present disclosure.

Referring now to FIGS. 14 and 15, another embodiment of the lighting system 100 is shown. Specifically, FIG. 14 is a top perspective view of the lighting system 100, whereas FIG. 15 is a side view of the lighting system 100. Similar to the embodiments described above, the lighting system 100 includes a detachable flashlight head 102 and a flashlight base 106. Specifically, the detachable flashlight head 102 is shown as being physically, magnetically, and/or electrically coupled to the flashlight base 106. While a headguard 104 is not shown in FIGS. 14 and 15, it is understood that the lighting system 100 of FIGS. 14 and 15 may further include the headguard 104 of FIG. 1 or similar headguard.

In some desired modes of operation, the detachable flashlight head 102 is configured to operate in conjunction with the headguard 104 and/or the flashlight base 106. For instance, the detachable flashlight head 102 may be coupled to the flashlight base 106 to provide the operator with a larger flashlight body, which is desirable for certain types of applications in which lighting is required. In another example, the detachable flashlight head 102 may be coupled to the headguard 104 to provide the operator with a headlamp or a hands-free lighting solution, which is more practical for certain types of applications in which hands-free lighting is required, such as mining, construction, vehicle maintenance, etc. In some embodiments, when the detachable flashlight head 102 is docked in the flashlight base 106 or the headguard 104, the lumens of the detachable flashlight head 102 are configured to increase to produce a much higher illumination.

The detachable flashlight head 102 may operate independently of either the headguard 104 and/or the flashlight base 106. For instance, the detachable flashlight head 102 may be removed from the headguard 104 or the flashlight base 106 to be utilized as a small lighting device that may be positioned in locations in which a larger flashlight body or a headlamp is not practical.

Figure 18:
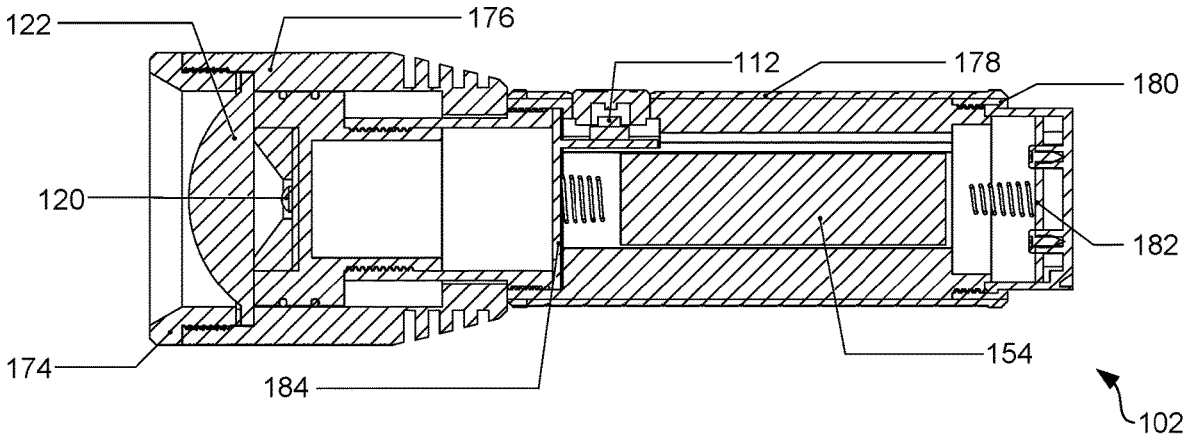
FIG. 18 is a side cross-sectional view of the detachable flashlight head in accordance with various embodiments of the present disclosure.
Figure 19:
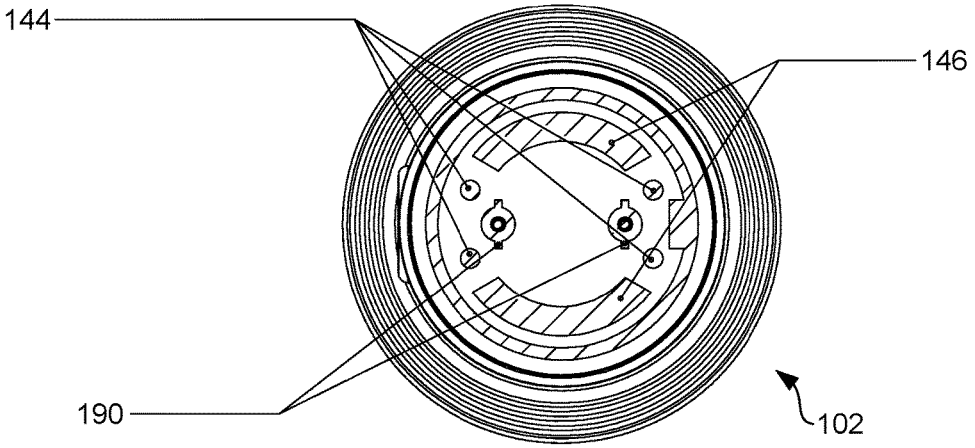
FIG. 19 is a rear cross-sectional view of the detachable flashlight head in accordance with various embodiments of the present disclosure.
Figure 20:
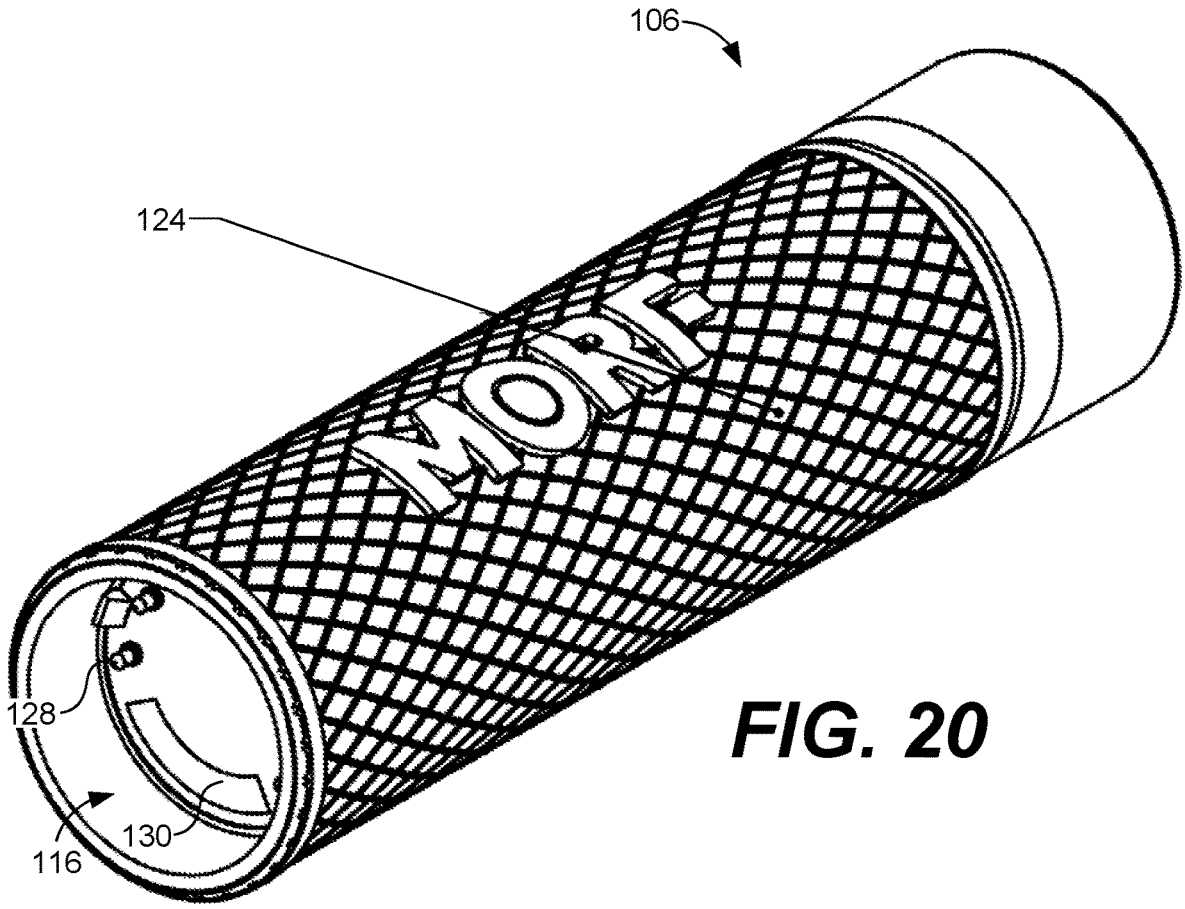
FIG. 20 is a top perspective view of the flashlight base in accordance with various embodiments of the present disclosure.

Enlarged views of the detachable flashlight head 102, depicted separate from the flashlight base 106, are shown in FIGS. 16 and 17. Similarly, an enlarged view of the flashlight base 106, depicted separate from the detachable flashlight head 102, is shown in FIG. 20. A side cross-sectional view of the detachable flashlight head 102 is shown in FIG. 18, and a rear cross-sectional view of the detachable flashlight head 102 is shown in FIG. 19.

Referring collectively to FIGS. 16-19, to facilitate the removability and independent operation of the detachable flashlight head 102, the detachable flashlight head 102 may include a power source independent of the headguard 104 and the flashlight base 106. For instance, in some embodiments, the detachable flashlight head 102 may include a power source, such as one or more batteries 154, that permit the detachable flashlight head 102 to power one or more light sources, such as light emitting diodes (LEDs), independent of a power supply or other light source of the headguard 104 and/or the flashlight base 106. The one or more batteries 154 may include rechargeable batteries 154 in some embodiments.

Referring to FIGS. 16 and 17, an enlarged view of the detachable flashlight head 102 is shown. The detachable flashlight head 102 may include a flashlight head housing 108. In some embodiments, the flashlight head housing 108 may include a longitudinally extending and substantially tubular housing, as shown in FIG. 16. Further, the flashlight head housing 108 may include ridges 110 and/or a textured bezel 172 projecting from a surface of the flashlight head housing 108 in one or more regions of the flashlight head housing 108, which may facilitate gripping the detachable flashlight head 102 using fingertips or other suitable portion of a hand.

The ridges 110 and the textured bezel 172 are shown in a front portion of the flashlight base housing 124 in the embodiment of FIG. 16; however, it is understood that the ridges 110 and/or the textured bezel 172 may be positioned towards a central region or a distal rear end of the flashlight head housing 108 in some embodiments. A head switch 112 may be positioned on a top portion of the detachable flashlight head 102 that may be coupled to circuitry of the detachable flashlight head 102 for toggling the lighting element between on-and-off positions or between different modes of operation (e.g., strobing, high intensity illumination, low intensity illumination, etc.). The head switch 112 may include a sliding switch or a button switch in some embodiments.

The flashlight head housing 108 may include a base 114 having a width and/or diameter less than the central and/or front portion of the flashlight head housing 108. As such, the base 114 may be positioned, nested, or otherwise placed in a cavity or an aperture of the flashlight base 106, headguard 104, or other suitable mount.

For instance, referring to FIGS. 1, 16, and 17 collectively, the base 114 of the detachable flashlight head 102 of FIG. 16 may be nested in a flashlight base cavity 116 of the flashlight base 106 or a headguard cavity 118 of the headguard 104 such that the base 114 is wholly or partially encapsulated by a projecting portion of the flashlight base 106 or the headguard 104. While FIG. 16 shows the base 114 being sized and positioned for being nested in the flashlight base cavity 116, in alternative embodiments, the detachable flashlight head 102 may include a cavity whereas the headguard 104 includes a projecting region similar to the base shown in FIG. 16 that nests in the cavity of the detachable flashlight head 102. In some embodiments, neither component nests with respect to one another.

Referring now to FIGS. 18 and 19, the detachable flashlight head 102 may further include a head LED 120 or other bulb, a lens 122 (e.g., a clear plastic lens), an accent ring 174, a slide focus head 176, a rubber grip 178, a lock ring 180, charging circuitry 182 (e.g., a charging circuit PCB), primary circuitry 184 (e.g., circuitry that handles the head switch 112 and operation of the head LED 120), a reflector (not shown), and other components as may be appreciated. The head LED 120 may include a plurality of LEDs, as may be appreciated, or a multitude of different bulbs or light sources. Referring specifically to FIG. 19, a rear face of the detachable flashlight head 102 may include head electrical contacts 144, head magnets 146, posts 190 (e.g., PCB posts), as well as other components, as may be appreciated. The electrical contacts described herein may also be referred to as charging contacts in some embodiments.

Now, turning to FIG. 20, an enlarged view of the flashlight base 106 is shown in accordance with various embodiments. The flashlight base 106 may include a flashlight base housing 124. In some embodiments, the flashlight base housing 124 may include a longitudinally extending and substantially tubular housing, as shown in FIG. 20, where the length of the flashlight base housing 124 is longer, or substantially longer, than a length of the detachable flashlight head 102 (e.g., two to three times the length or larger).

When the detachable flashlight head 102 is positioned in the flashlight base cavity 116 of the flashlight base 106, the detachable flashlight head 102 may form a physical, magnetic, and/or electrical connection with the flashlight base 106. The physical connection may include a snapping mechanism, an interference fit, a friction fit, or other physical connection as may be appreciated.

In some embodiments, the magnetic attraction between the detachable flashlight head 102 and the flashlight base 106 may cause the detachable flashlight head 102 to align such that an electrical connection is formed between the detachable flashlight head 102 and the flashlight base 106. In other words, the magnetic attraction orients electrical connects on a rear portion of the detachable flashlight head 102 to align with electrical contacts positioned on the flashlight base 106 (e.g., in the flashlight base cavity 116).

Figure 21:
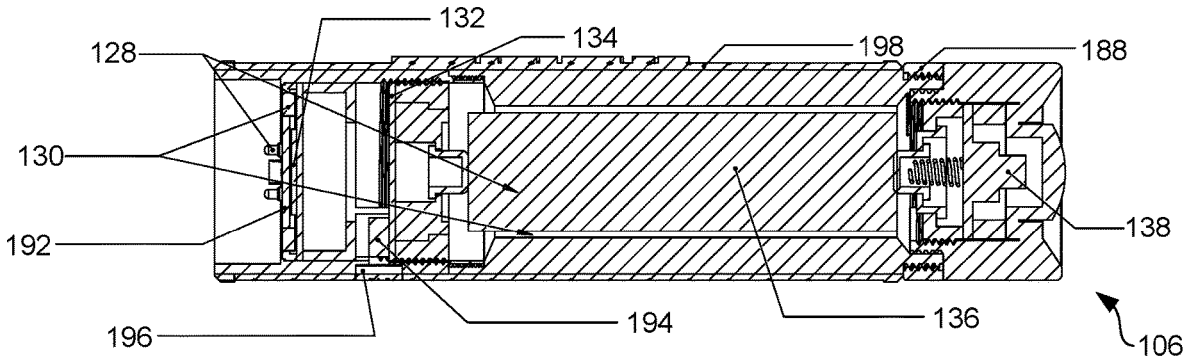
FIG. 21 is a side cross-sectional view of the flashlight base in accordance with various embodiments of the present disclosure.
Figure 22:
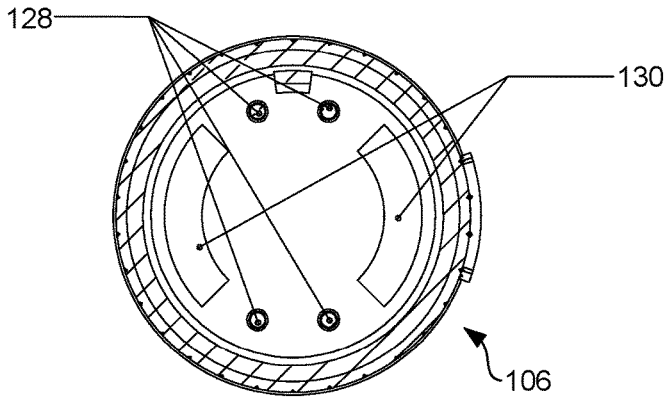
FIG. 22 is a rear cross-sectional view of the flashlight base in accordance with various embodiments of the present disclosure.
Figure 23:
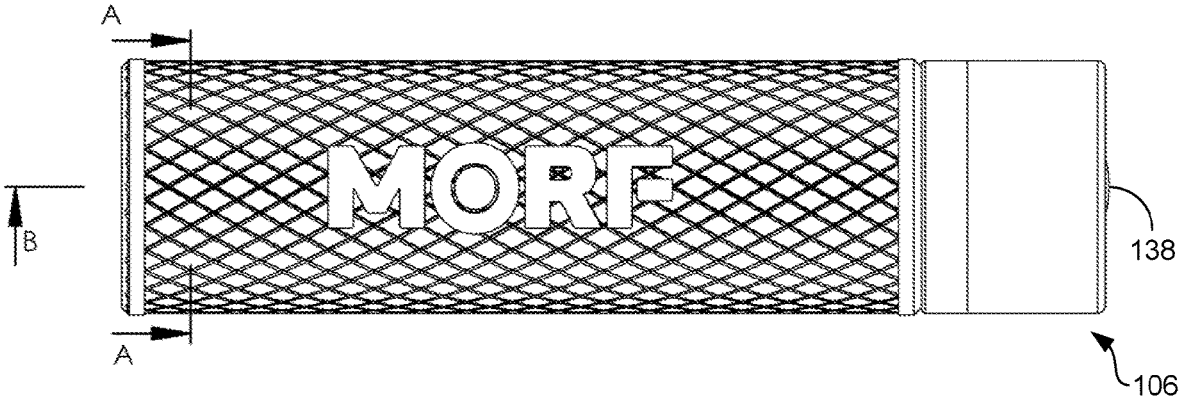
FIG. 23 is a side elevation view of the flashlight base in accordance with various embodiments of the present disclosure.
Figure 24:
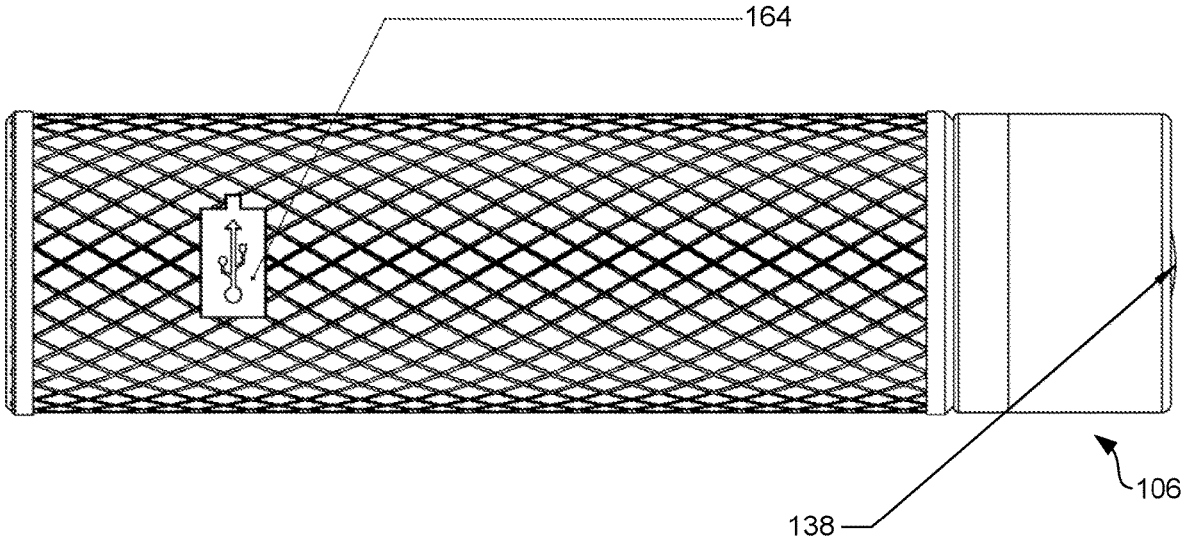
FIG. 24 is another side elevation view of the flashlight base in accordance with various embodiments of the present disclosure.

As such, in addition to the flashlight base cavity 116, the flashlight base 106 may include base electrical contacts 128, base magnets 130, and other components. Referring collectively to a side cross-sectional view of the flashlight base 106 shown in FIG. 21 and a rear cross-sectional view of the flashlight base 106 shown in FIG. 22, the flashlight base 106 may further include base LED(s) 132, base circuitry 134 (e.g., printed circuit board (PCB) circuitry), battery 136 (e.g., rechargeable battery), a base switch 138, presence sensor 140, as well as other components. In some embodiments, the base LED 132 is a chip-on-board LED area light. The flashlight base 106 may further include a base lens 192 (e.g., a clear plastic lens), a charging port 194 (e.g., a micro-USB charging port, a USB-C charging port, or other suitable charging port), a charging port cover 196, a rubber exterior 198, an accent ring 188, as well as other components.

Additionally, in some embodiments, the flashlight base 106 may include one or more base LEDs 132 or other lighting elements to provide lighting in the flashlight base cavity 116 (or on the front of the flashlight base 106) when the detachable flashlight head 102 is removed. As such, the flashlight base 106 may be described as having secondary illumination. The presence, or lack thereof, of the detachable flashlight head 102 may be determined using a presence sensor 140, shown in FIG. 3, which may include a push button, electrical connection sensor, or similar sensor.

Referring again to FIG. 20, in some embodiments, the flashlight base 106 may include a base switch 138, such as a power button. When the detachable flashlight head 102 is coupled to the flashlight base 106, the base switch 138 may toggle a lighting element, such as the head LED 120 in the detachable flashlight head 102 between on-and-off positions or between different modes of operation (e.g., strobing, high intensity illumination, low intensity illumination, etc.). As the base switch 138 may be positioned on a rear face of the flashlight base 106, the base switch 138 is better illustrated in FIG. 15.

In some embodiments, the base switch 138 may be formed of a transparent material with a multi-color LED or other lighting element disposed underneath. When the detachable flashlight head 102 is coupled to the flashlight base 106 and a charging process is initiated, the multi-color LED may cause the base switch 138 to illuminate a first color (e.g., red) during the charging process and change to a second, different color (e.g., green) when charging has completed. Additionally, a button of the head switch 112 and a battery pack switch 142 on the battery pack 162 may include similar functionality.

The detachable flashlight head 102 similarly has head electrical contacts 144 and head magnets 146 that come into contact with the base electrical contacts 128 and base magnets 130 of the flashlight base 106, thereby forming magnetic and/or electrical connections. Additionally, the detachable flashlight head 102 includes lighting circuitry 148 having one or more lighting elements (e.g., head LEDs 120) disposed thereon, a light cup 150, the head switch 112 (e.g., an on/off button), circuitry 152 (e.g., PCB boards), and one or more rechargeable batteries 154.

As noted above, the detachable flashlight head 102 may include a head switch 112 and the flashlight base 106 may include a base switch 138 along with corresponding processing circuitry. The processing circuitry may include an integrated circuit (IC) or a microcontroller in some examples. Through operation of the processing circuitry, the switches 112, 138 may toggle the light source and/or mode of operation of the detachable flashlight head 102. For instance, in some embodiments, the switches 112, 138 may be manipulated by the operator to turn the light source on or off. In addition to or in lieu of toggling the light source, the switches 112, 138 may iterate through different modes of operation. The different modes of operation may include, for example, pulsating the light source (e.g., performing a strobe effect), providing a constant light source typical to a flashlight, varying the color of the light source, varying the luminous intensity of the light source, or other operation as may be appreciated.

In some embodiments, a method for providing a light source is described that includes providing a headguard 104 adapted to be worn on a head of an operator; providing a flashlight base 106 having an extended body; and providing a detachable flashlight head 102 configured to detachably attach to the headguard 104 and the flashlight base 106, where the detachable flashlight head 102 has a power supply independent of the headguard 104 and the flashlight base 106 such that the detachable flashlight head operates independently of the headguard and the flashlight base. The method may further include using the detachable flashlight head 102 as a light source while the detachable flashlight head 102 is coupled to the headguard 104; using the detachable flashlight head 102 as a light source while the detachable flashlight head 102 is coupled to the flashlight base 106; and/or using the detachable flashlight head 102 as an independent light source when the detachable flashlight head 102 is not coupled to either the headguard 104 or the flashlight base 106.

As noted above, the headguard 104 may include a headguard magnet 164 and a headguard electrical contact 166, whereas the flashlight base comprises a base magnet 130 and a base electrical contact 128. The detachable flashlight head 102 includes a head magnet 146 and a head electrical contact 144. When the head magnet 146 comes into contact with the headguard magnet 164, the headguard magnet 164 causes the head electrical contact 144 to align with the headguard electrical contact 166 and form an electrical connection therewith. Similarly, when the head magnet 146 comes into contact with the base magnet 130, the base magnet 130 causes the detachable head electrical contact 144 to align with the base electrical contact 128 and form an electrical connection therewith.

The headguard 104 may include a headguard cavity 118, whereas the flashlight base 106 may include a flashlight base cavity 116. Further, the detachable flashlight head 102 may include a base 114 configured to nest within the headguard cavity 118 and the flashlight base cavity 116 and form an interference connection therewith.

In further embodiments, the headguard 104 includes a headguard light source, such as one or more headguard LEDs 170, the flashlight base 106 includes a base light source, such as one or more base LEDs 132, and the detachable flashlight head 102 comprises a head light source, such as one or more head LEDs 120.

The headguard 104 may further include a presence sensor 168. The method may further include detecting a presence of the detachable flashlight head 102 in the headguard cavity 118 and a lack thereof using the presence sensor 168, in response to the detachable flashlight head 102 not being present in the headguard cavity 118, turning on the headguard light source, and, in response to the detachable flashlight head 102 being present in the headguard cavity 118, turning off the headguard light source.

Similarly, the flashlight base 106 may further include a presence sensor 140. The method may further include detecting a presence of the detachable flashlight head 102 in the flashlight base cavity 116 and a lack thereof using the presence sensor 140, in response to the detachable flashlight head 102 not being present in the flashlight base cavity 116, turning on the flashlight base light source, and, in response to the detachable flashlight head 102 being present in the flashlight base cavity 116, turning off the headguard light source.

Further, in some embodiments, the flashlight base 106 further includes a switch 138 and a presence sensor 140. The method may further include detecting a presence of the detachable flashlight head 102 in the base cavity 116 and a lack thereof using the presence sensor 140. In response to the detachable flashlight head 102 not being present in the flashlight base cavity 116 and the switch 138 being manipulated, the base light source may be toggled (e.g., turned off or on, or different modes of operation enabled). Similarly, in response to the detachable flashlight head 102 being present in the headguard cavity, the head light source (e.g., turned off or on, or different modes of operation enabled).

The switch 138 may be formed of a transparent material having a multi-color light emitting diode (LED) disposed underneath. As such, the method may further include detecting the presence of the detachable flashlight head 102 in the flashlight base cavity 116 and a lack thereof using the presence sensor 140; when the detachable flashlight head 102 is coupled to the flashlight base 106 and a charging process is initiated in which a battery of the flashlight base 106 is charging a battery of the detachable flashlight head 102, causing the multi-color LED to illuminate a first color during the charging process; and causing the multi-color LED to illuminate a second color when the charging process has been completed, the second color being different than the first color.

The features, structures, or characteristics described above may be combined in one or more embodiments in any suitable manner, and the features discussed in the various embodiments are interchangeable, if possible. In the following description, numerous specific details are provided in order to fully understand the embodiments of the present disclosure. However, a person skilled in the art will appreciate that the technical solution of the present disclosure may be practiced without one or more of the specific details, or other methods, components, materials, and the like may be employed. In other instances, well-known structures, materials, or operations are not shown or described in detail to avoid obscuring aspects of the present disclosure.

Although the relative terms such as "on," "below," "upper," and "lower" are used in the specification to describe the relative relationship of one component to another component, these terms are used in this specification for convenience only, for example, as a direction in an example shown in the drawings. It should be understood that if the device is turned upside down, the "upper" component described above will become a "lower" component. When a structure is "on" another structure, it is possible that the structure is integrally formed on another structure, or that the structure is "directly" disposed on another structure, or that the structure is "indirectly" disposed on the other structure through other structures.

In this specification, the terms such as "a," "an," "the," and "said" are used to indicate the presence of one or more elements and components. The terms "comprise," "include," "have," "contain," and their variants are used to be open ended, and are meant to include additional elements, components, etc., in addition to the listed elements, components, etc. unless otherwise specified in the appended claims. The terms "first," "second," etc. are used only as labels, rather than a limitation for a number of the objects.

The above-described embodiments of the present disclosure are merely possible examples of implementations set forth for a clear understanding of the principles of the disclosure. Many variations and modifications may be made to the above-described embodiment(s) without departing substantially from the spirit and principles of the disclosure. All such modifications and variations are intended to be included herein within the scope of this disclosure and protected by the following claims.

Therefore, the following is claimed:

1. A system, comprising:

a headguard adapted to be worn on a head of an operator;

a flashlight base having an extended body; and a detachable flashlight head configured to detachably attach to the headguard and the flashlight base, wherein the detachable flashlight head has a power supply independent of the headguard and the flashlight base such that the detachable flashlight head operates independently of the headguard and the flashlight base;

wherein the headguard comprises a headguard cavity; the flashlight base comprises a base cavity; and the detachable flashlight head comprises a base configured to nest within the headguard cavity and the base cavity and form an interference connection therewith; and wherein the headguard comprises a headguard light source; the flashlight base comprises a base light source; and the detachable flashlight head comprises a head light source.

2. The system of claim 1, wherein the headguard further comprises:

a presence sensor; and processing circuitry configured to:

detect a presence of the detachable flashlight head in the headguard cavity and a lack thereof using the presence sensor;

in response to the detachable flashlight head not being present in the headguard cavity, turning on the headguard light source; and in response to the detachable flashlight head being present in the headguard cavity, turning off the headguard light source.

3. The system of claim 1, wherein the flashlight base further comprises:

a presence sensor; and processing circuitry configured to:

detect a presence of the detachable flashlight head in the base cavity and a lack thereof using the presence sensor;

in response to the detachable flashlight head not being present in the base cavity, turn on the base light source; and in response to the detachable flashlight head being present in the base cavity, turn off the base light source.

4. The system of claim 1, wherein the flashlight base further comprises:

a switch;

a presence sensor; and processing circuitry configured to:

detect a presence of the detachable flashlight head in the base cavity and a lack thereof using the presence sensor;

in response to the detachable flashlight head not being present in the base cavity and the switch being manipulated, toggle the base light source on; and in response to the detachable flashlight head being present in the base cavity, toggle the base light source off.

5. The system of claim 4, wherein the switch is formed of a transparent material having a multi-color light emitting diode (LED) disposed underneath.

6. The system of claim 5, wherein the processing circuitry of the detachable flashlight head is further configured to:

detect the presence of the detachable flashlight head in the base cavity and a lack thereof using the presence sensor;

when the detachable flashlight head is coupled to the flashlight base and a charging process is initiated in which a battery of the flashlight base is charging a battery of the detachable flashlight head, cause the multi-color LED to illuminate a first color during the charging process; and cause the multi-color LED to illuminate a second color when the charging process has been completed, the second color being different than the first color.

7. The system of claim 6, wherein the flashlight base comprises a rubber body cover, a charging port, and a charging port cover.

8. A method for providing a light source, comprising:

providing a headguard adapted to be worn on a head of an operator;

providing a flashlight base having an extended body;

providing a detachable flashlight head configured to detachably attach to the headguard and the flashlight base, wherein the detachable flashlight head has a power supply independent of the headguard and the flashlight base such that the detachable flashlight head operates independently of the headguard and the flashlight base;

using the detachable flashlight head as a light source while the detachable flashlight head is coupled to the headguard;

using the detachable flashlight head as a light source while the detachable flashlight head is coupled to the flashlight base; and using the detachable flashlight head as an independent light source when the detachable flashlight head is not coupled to either the headguard or the flashlight base:

wherein the headguard comprises a headguard cavity; the flashlight base comprises a base cavity; and the detachable flashlight head comprises a base configured to nest within the headguard cavity and the base cavity and form an interference connection therewith: and:

wherein the headguard comprises a headguard light source; the flashlight base comprises a base light source; and the detachable flashlight head comprises a head light source.

9. The method of claim 8, wherein the headguard further comprises a presence sensor; and the method further comprises:

detecting a presence of the detachable flashlight head in the headguard cavity and a lack thereof using the presence sensor;

in response to the detachable flashlight head not being present in the headguard cavity, turning on the headguard light source; and in response to the detachable flashlight head being present in the headguard cavity, turning off the headguard light source.

10. The method of claim 8, wherein the flashlight base further comprises a presence sensor; and the method further comprises:

detecting a presence of the detachable flashlight head in the base cavity and a lack thereof using the presence sensor;

in response to the detachable flashlight head not being present in the base cavity, turning on the base light source; and in response to the detachable flashlight head being present in the base cavity, turning off the base light source.

11. The method of claim 8, wherein the flashlight base further comprises a switch and a presence sensor; and the method further comprises:

detecting a presence of the detachable flashlight head in the base cavity and a lack thereof using the presence sensor;

in response to the detachable flashlight head not being present in the base cavity and the switch being manipulated, toggling the base light source on; and in response to the detachable flashlight head being present in the base cavity, toggling the head light source off.

12. The method of claim 11, wherein the switch is formed of a transparent material having a multi-color light emitting diode (LED) disposed underneath.

13. The method of claim 12, further comprising:

detecting the presence of the detachable flashlight head in the base cavity and a lack thereof using the presence sensor;

when the detachable flashlight head is coupled to the flashlight base and a charging process is initiated in which a battery of the flashlight base is charging a battery of the detachable flashlight head, causing the multi-color LED to illuminate a first color during the charging process; and causing the multi-color LED to illuminate a second color when the charging process has been completed, the second color being different than the first color.

14. The method of claim 13, wherein the flashlight base comprises a rubber body cover, a charging port, and a charging port cover.

* * * * *